US009022907B2

(12) United States Patent
Wang

(10) Patent No.: US 9,022,907 B2
(45) Date of Patent: May 5, 2015

(54) ADJUSTABLE DUMBBELL SYSTEM

(71) Applicant: Beto Engineering and Marketing Co., Ltd., Taichung (TW)

(72) Inventor: Lopin Wang, Taichung (TW)

(73) Assignee: Beto Engineering and Marketing Co., Ltd., Taichung (TW)

( * ) Notice: Subject to any disclaimer, the term of this patent is extended or adjusted under 35 U.S.C. 154(b) by 226 days.

(21) Appl. No.: 13/898,977

(22) Filed: May 21, 2013

(65) Prior Publication Data

US 2014/0349820 A1 Nov. 27, 2014

(51) Int. Cl.

| | |
|---|---|
| ***A63B 21/075*** | (2006.01) |
| ***A63B 71/00*** | (2006.01) |
| ***A63B 21/072*** | (2006.01) |
| ***A63B 21/00*** | (2006.01) |
| *A63B 21/062* | (2006.01) |

(52) U.S. Cl.

CPC ..... *A63B 21/075* (2013.01); *A63B 71/0036* (2013.01); *A63B 21/0726* (2013.01); *A63B 21/0728* (2013.01); *A63B 2021/0623* (2013.01); *A63B 21/00065* (2013.01)

(58) Field of Classification Search

CPC . A63B 21/072; A63B 21/075; A63B 21/0726

See application file for complete search history.

(56) References Cited

U.S. PATENT DOCUMENTS 2,476,734 A * 7/1949 Jellison ..... 294/82.32
7,261,678 B2 * 8/2007 Crawford et al. ..... 482/107

* cited by examiner

*Primary Examiner* — Loan H Thanh
*Assistant Examiner* — Rae Fischer
(74) *Attorney, Agent, or Firm* — Muncy, Geissler, Olds & Lowe, P.C.

(57) ABSTRACT

An adjustable dumbbell system includes a handle including a grip, two hanging rods at two ends of the grip and multiple through holes at each hanging rod, multiple weights, each weight defining an elongated top slot and a bottom opening and having a scissor hook mounted therein, the scissor hook including a hook unit, an actuation unit drivable by an external force to open or close the hook unit and elastic members adapted to hold the hook unit in the close position, a holder base for accommodating the weights, and a selector including multiple control units that are attached to the bottom openings of the weights when the weights are accommodated in the holder base and a selector rotatable to move the control units in driving the actuation units of the scissor hooks of the weight to open or close the hook units of the respective scissor hooks.

4 Claims, 7 Drawing Sheets

ADJUSTABLE DUMBBELL SYSTEM

BACKGROUND OF THE INVENTION

1. Field of the Invention

The present invention relates to exercise apparatus and more particularly, to an adjustable dumbbell system.

2. Description of the Related Art

Adjustable dumbbells for allowing adjustment of the total weight are commercially available. Exemplar is seen in U.S. Pat. No. 7,261,678B2. However, these conventional designs commonly have the weight-selection selector mounted in the handle of the dumbbell. However, if the dumbbell is hit by an external object or fall to the ground accidentally during an exercise or delivery, the weight-selection selector can be damaged.

SUMMARY OF THE INVENTION

The present invention has been accomplished under the circumstances in view. It is the main object of the present invention to provide an adjustable dumbbell system, which has the weight-selecting selector mounted in the holder base, avoiding dumbbell damage during operation or delivery.

To achieve this and other objects of the present invention, an adjustable dumbbell system in accordance with the present invention comprises a handle, multiple weights, a holder base, and a selector. The handle comprises a grip and two hanging rods respectively axially extended from two opposite ends of the grip in reversed directions. Each hanging rod has a plurality of through holes. The weights are flat plate-shaped members mountable at the hanging rods of the handle. Each weight comprises opposing top side and bottom side and opposing left side and right side, an elongated top slot vertically downwardly extended from the top side for receiving one hanging rod of the handle, a bottom opening located at the bottom side, and a scissor hook mounted therein. The scissor hook comprises a hook unit disposed in a bottom side in the elongated top slot, an actuation unit disposed in the bottom opening and drivable by an external force to move the hook unit between a close position where the hook unit is hooked in one through hole of one hanging rod of the handle to secure the respective weight to the handle and an open position where the hook unit is disengaged from the respective through hole of the respective hanging rod of the handle, and at least one elastic member adapted to hold the hook unit in the close position. The holder base comprises a plurality of locating grooves located at a top side thereof for accommodating the weights. The selector is mounted in the holder base, comprising a selector knob disposed outside the holder base, and a plurality of control units disposed in the locating grooves. The control units are respectively attached to the bottom openings of the weights when the weights are placed in the locating grooves of the holder base. The control units are biasable by the selector knob to drive the actuation units of the scissor hooks of the respective weights to open/close the respective hook units.

Subject to the aforesaid structural design, the invention has the selector mounted in the holder base that is normally kept immovable in a particular place and adapted to accommodate the weights when the dumbbell is not in use. Thus, the selector will not be damaged accidentally when the user uses the dumbbell to perform gymnastic exercises.

DETAILED DESCRIPTION OF THE INVENTION

As illustrated in the annexed drawings, an adjustable dumbbell system in accordance with the present invention comprises a handle 10, a predetermined even number of weights 20, a holder base 40, and a selector 50.

Figure 1:
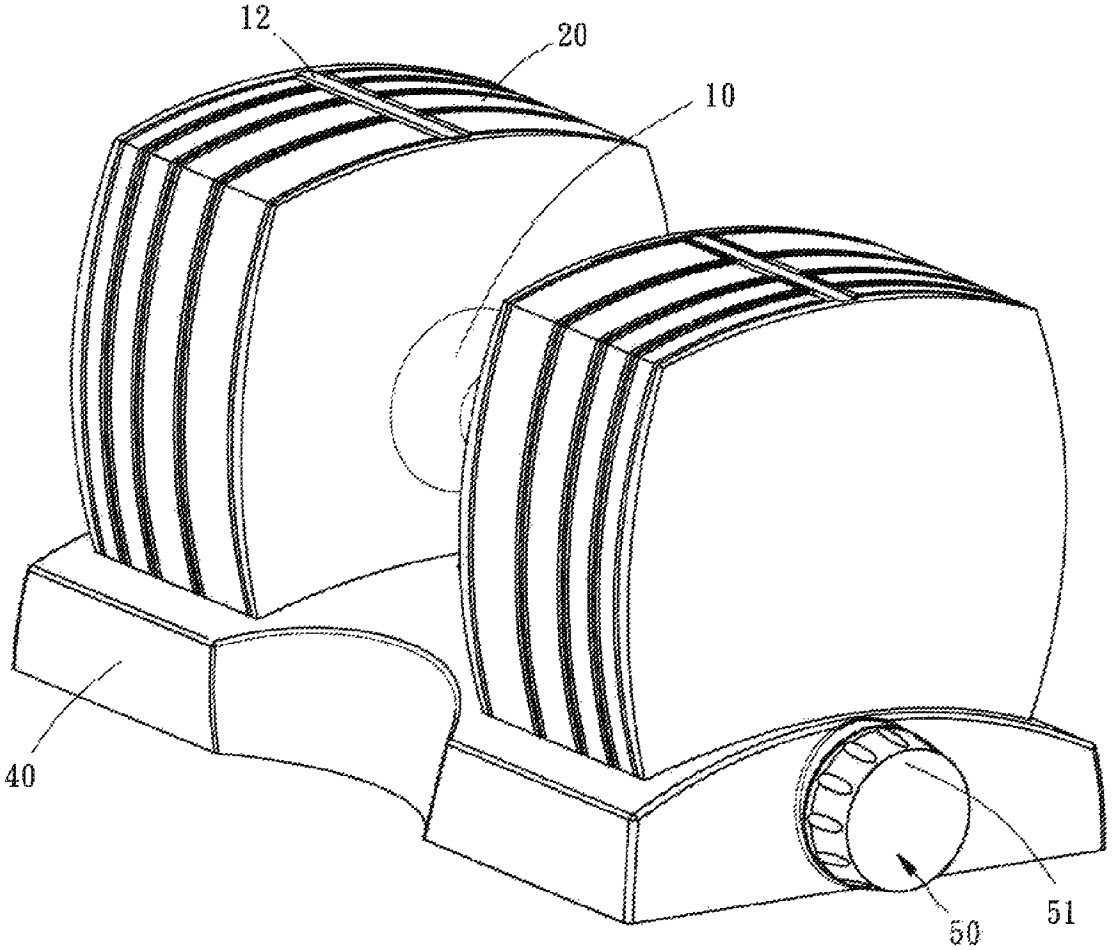
FIG. 1 is an elevational view of an adjustable dumbbell system in accordance with the present invention.
Figure 2:
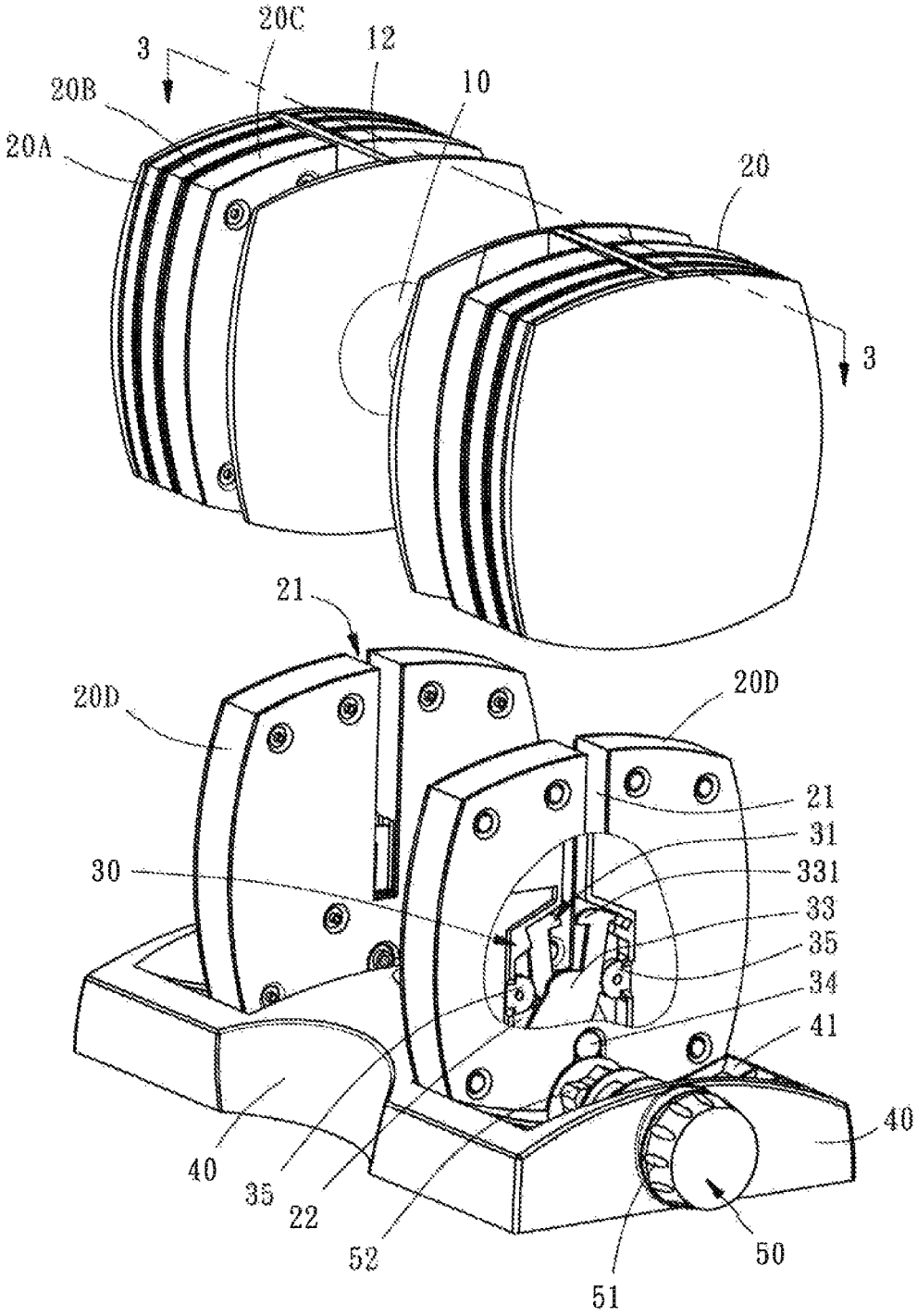
FIG. 2 is a schematic drawing of the present invention, illustrating the dumbbell lifted and two weights left in the holder base, wherein the front-sided weight is illustrated in a sectional elevation.
Figure 3:
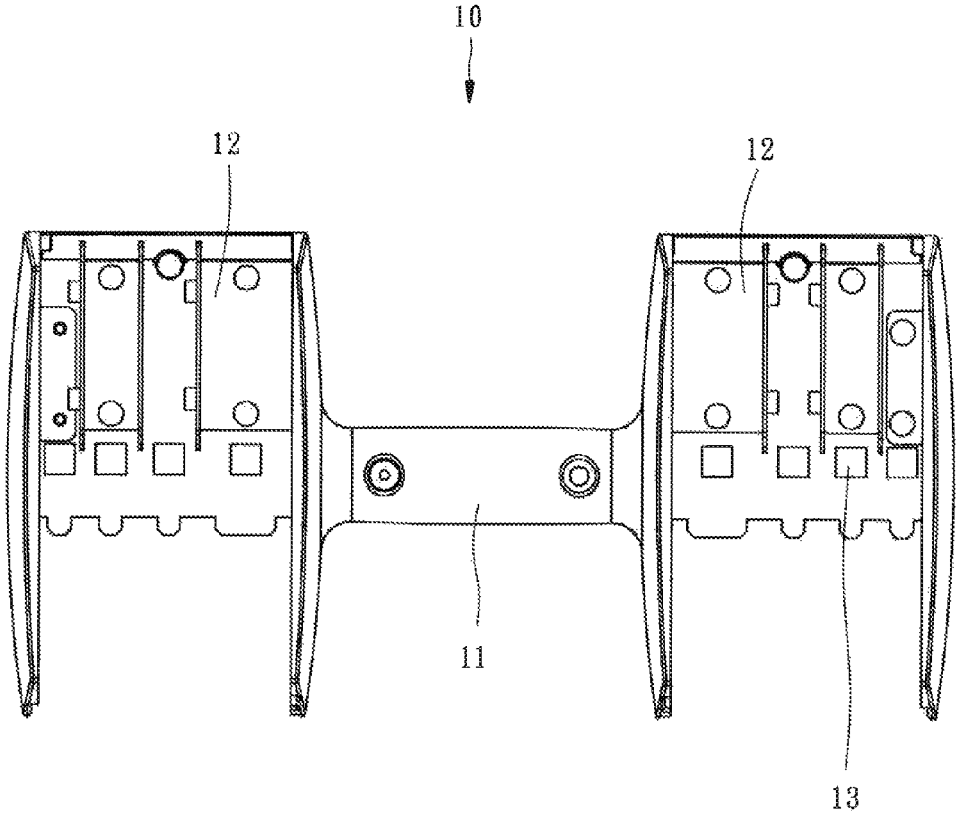
FIG. 3 is a sectional front view taken along line 3-3 of FIG. 2, illustrating the configuration of the handle.
Figure 4:
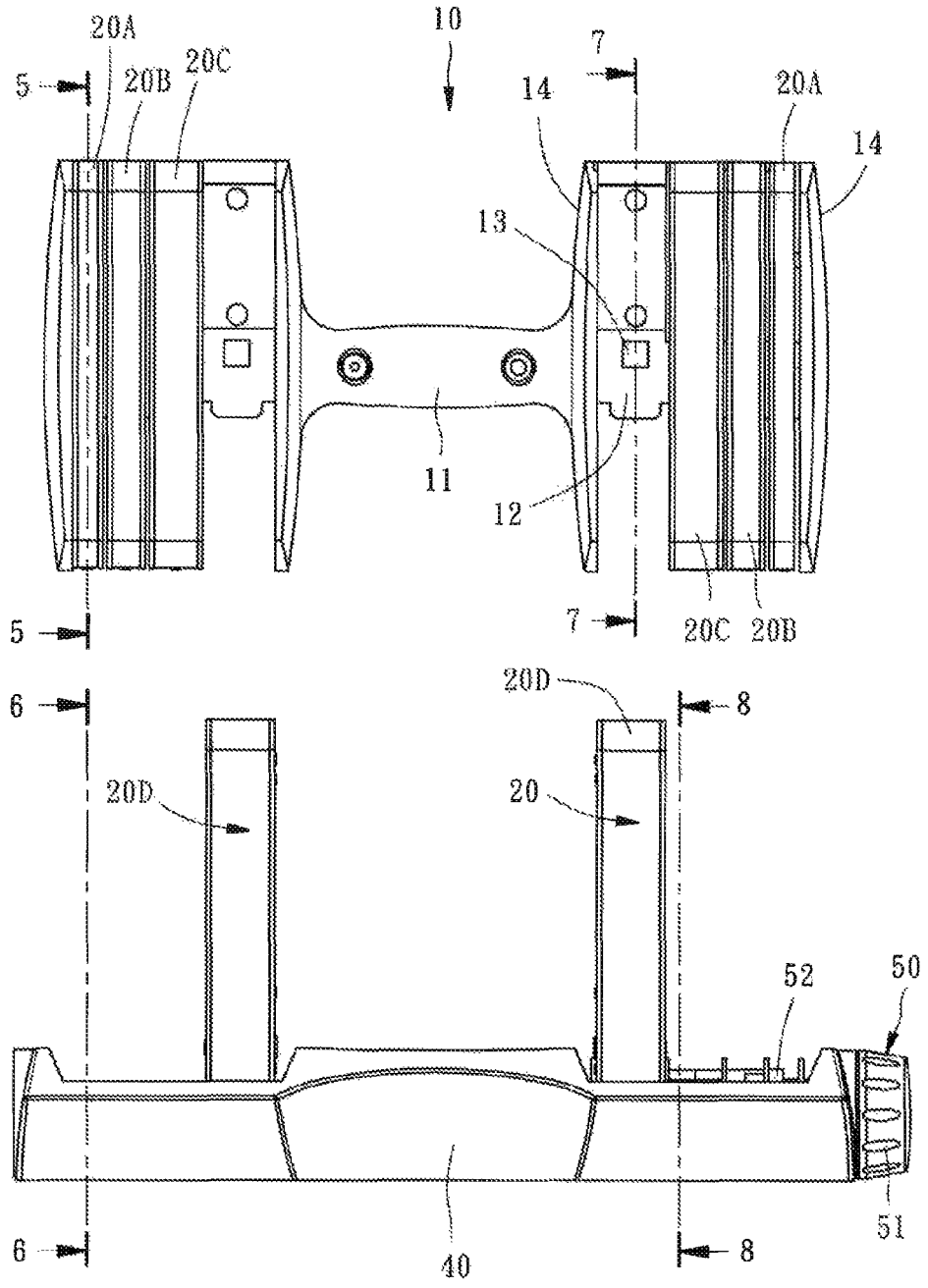
FIG. 4 is a front view of FIG. 3.
Figure 5:
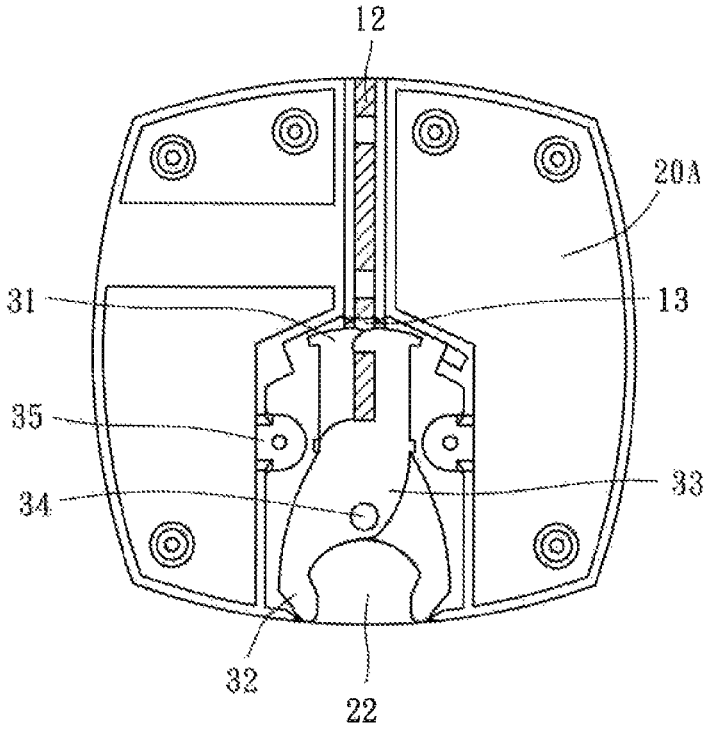
FIG. 5 is a sectional front view taken along line 5-5 of FIG. 4, illustrating the internal structure of the first weight.
Figure 6:
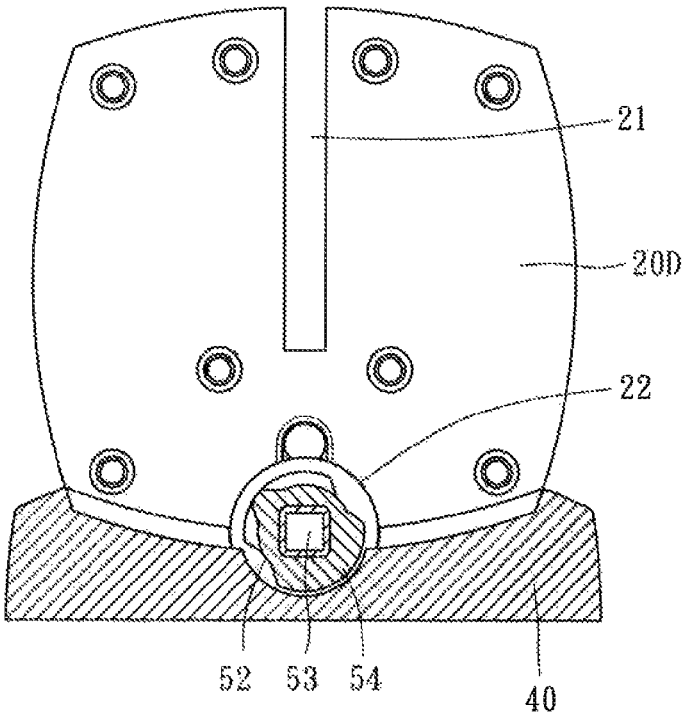
FIG. 6 is a sectional front view taken along line 6-6 of FIG. 5, illustrating the external structure of the fourth weight.
Figure 7:
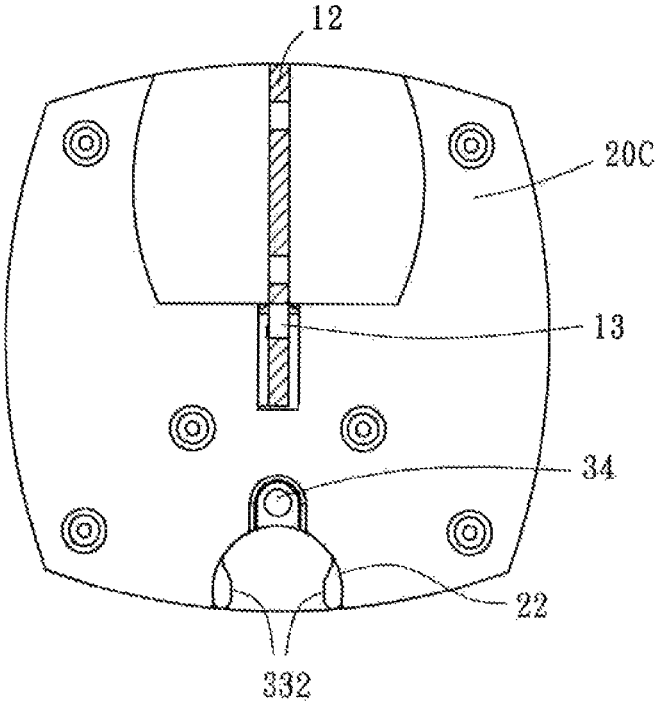
FIG. 7 is a sectional front view taken along line 7-7 of FIG. 4, illustrating the external structure of the third weight.

The handle 10, as shown in FIG. 3, comprises a grip 11, two hanging rods 12 respectively axially extended from two opposite ends of the grip 11 in reversed directions, and an end plate 14 located at each of two opposite ends of each of the two hanging rods 12. Each hanging rod 12 comprises a plurality of through holes 13 spaced along the length thereof.

Figure 8:
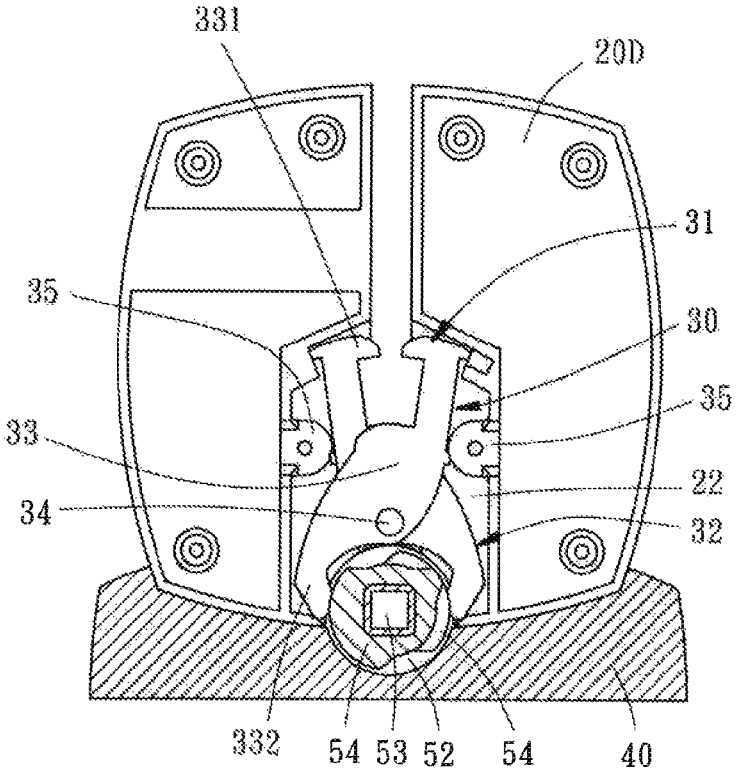
FIG. 8 is a sectional front view taken along line 8-8 of FIG. 4, illustrating the internal structure of the fourth weight.
Figure 9:
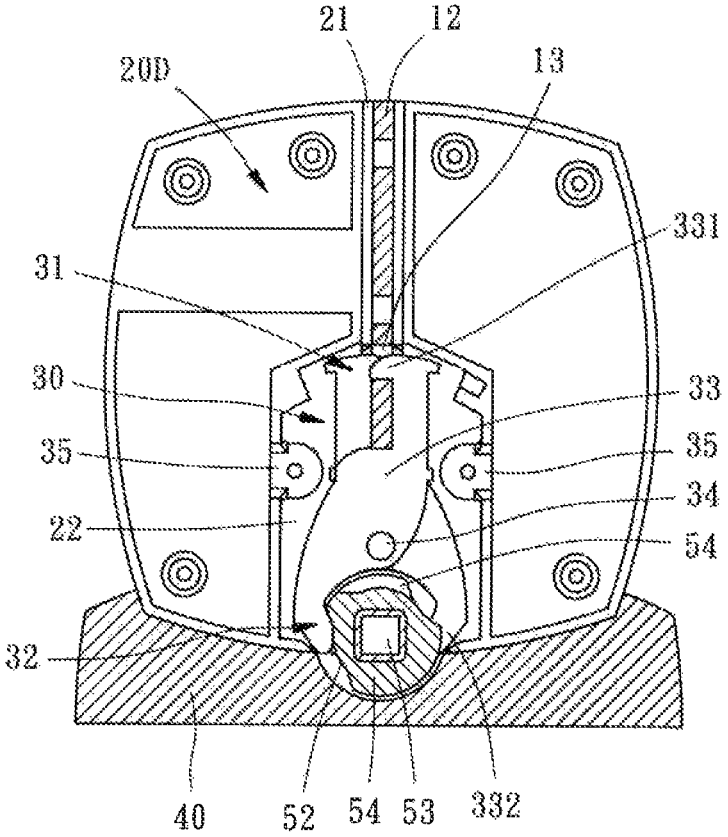
FIG. 9 is similar to FIG. 8, illustrating the hanging rod received in the elongated top slot of the fourth weight, the control unit disengaged from the actuation unit of the scissor hook, and the hook unit of the scissor hook hooked on the hanging rod.

The predetermined even number of weights 20 are arranged in two sets respectively mountable at the hanging rods 12. In this embodiment, each set of weights 20 include four weights alphabetically from A through D, i.e., the first weight 20A, the second weight 20B, the third weight 20C and the fourth 20D that increase gradually in weight from A to D. The user can selectively arrange the weights 20 into different combinations. Further, the weights 20 are flat plate-shaped members, having four sides, namely, opposing top and bottom sides and opposing left and right sides. Further, each weight 20 comprises an elongated top slot 21 vertically downwardly extended from the top side thereof for receiving one hanging rod 12 of the handle 10, a bottom opening 22 located at the bottom side thereof, and a scissor hook 30 mounted therein. The scissor hook 30 defines a hook unit 31 disposed in a bottom side in the elongated top slot 21, and an actuation unit 32 disposed in the bottom opening 22 and drivable by an external force to move the hook unit 31 between an open position (see FIG. 8) and a close position FIG. 9). When in the close position, the hook unit 31 can hook in one through hole 13 of the respective hanging rod 12 of the handle 10, securing the respective weight 20 to the handle 10. In this embodiment, the scissor hook 30 comprises two hook members 33 arranged in a crossed manner and pivotally connected together with a pivot 34 on the middle of the respective weight 20. Each hook member 33 has its one end terminating in a hook portion 331, and its other end terminating in a tail portion 332. The hook portions 331 of the hook members 33 form the aforesaid hook unit 31. The tail portions 332 of the hook members 33 fount the aforesaid actuation unit 32. The scissor hook 30 of each weight 20 further comprises at least one, for example, two elastic members 35 adapted to hold the hook unit 31 of the scissor hook 30 in the close position. Further, the elastic members 35 can be elastic rubber members, elastic plastic members, elastic rubber-plastic members, or spring members respectively disposed at an outer side relative to the two hook members 33. When the hook portions 331 of the hook members 33 are opened by an external force (see FIG. 8), the two elastic members 35 are compressed to store elastic potential energy that can move the hook members 33 back to the close position when the external force disappears.

The holder base 40 defines a plurality of locating grooves 41 at the top side thereof for accommodating the weights 20.

The selector 50 is mounted in the holder base 40, comprising a selector knob 51 disposed outside the holder base 40, and a plurality of control unit 52 disposed in the locating grooves 41. When the weights 20 are placed in the holder base 40, the bottom openings 22 of the weights 20 are attached to the respective control units 52. By means of rotating the selector knob 51, the angular positions of the control units 52 are relatively adjusted, driving the actuation units 32 of the scissor hooks 30 of the respective weights 20 to open or close the respective hook units 31. In this embodiment, the selector 50 further comprises a shaft 53 fixedly connected to the selector knob 51, and at least one, for example, two cam wheels 54 mounted at the shaft 53 and rotatable with the shaft 53 and the selector knob 50 to move the hook members 33 of the scissor hooks 30 of the weights 20 between the open position and the close position. The cam wheels 54 form the aforesaid control units 52.

Further, one single spring member (not shown) can be used in each weight 20 to hold the hook unit 31 of the scissor hook 30 in the close position. In this case, the two opposite ends of the spring member are respectively affixed to the two hook members of the scissor hook. No ally, the spring member holds the hook portions of the two hook member in the close position. When the two hook members of the scissor hook are opened by the respective cam wheel of the respective control unit of the selector, the spring member is stretched to store elastic potential energy. Thus, the use of one single spring member in each weight achieves the same effect as the aforesaid at least one elastic member.

During application, rotate the selector knob 51 to select the desired total weight. At this time, the control units 52 are rotated with the shaft 53 to the selected angle. When one control unit 52 reaches the open position shown FIG. 8, the respective actuation unit 32 is forced by the control unit 52 to open the respective hook unit 31, disengaging the respective hook unit 31 from the respective through hole 13 of the respective hanging rod 12. Therefore, when the handle 10 is lifted, the weight 20 is left in the respective locating groove 41 of the holder base 40. On the contrary, when one control unit 52 is rotated to the close position shown in FIG. 9, the respective actuation unit 32 is released from the respective hook unit 31, and the respective hook unit 31 is held by the elastic members 35 in the close position and hooked in the respective through hole 13 of the hanging rod 12, securing the respective weight 20 to the handle 10.

The invention has the selector installed in the holder base, streamlining appearance of the dumbbell and avoiding touching the selector during exercise. Therefore, the invention actually involves an inventive step.

What is claimed is:

1. An adjustable dumbbell system, comprising:

(A) a handle having a grip;

(B) two hanging rods respectively axially extended from two opposite ends of the grip in reversed direction, each the hanging rods comprising:

(1) a plurality of through holes; and (2) an even number of weights arranged in two sets mountable on the hanging rods of the handle, the weights being flat plate-shaped members, each of the weights comprising:

(a) opposing top and bottom sides;

(b) opposing left and right sides;

(c) an elongated top slot extending vertically downward from the top side for receiving one of the hanging rods of the handle;

(d) a bottom opening located on the bottom side; and (e) a scissor hook mounted in the weight and comprising:

(i) a hook unit disposed in the bottom of the elongated top slot;

(ii) an actuation unit disposed in the bottom opening and drivable by an external force to move the hook unit between a closed position, where the hook unit is hooked in one of the through holes to secure the weight to the handle, and an open position, where the hook unit is disengaged from the through holes; and (iii) an elastic member adapted to hold the hook unit in the closed position; and (C) a holder base comprising:

(1) a plurality of locating grooves located on the top side of the holder base for accommodating the weights; and (2) a selector mounted in the holder base and comprising:

(a) a selector knob disposed outside the holder base; and (b) a plurality of control units disposed in the locating grooves wherein each control units is attached to the bottom opening of a weight when the weights are placed in the locating grooves of the holder base, and wherein the control units are biasable by the selector knob to drive the actuation units of the scissor hooks of the respective weights to open and close the hook units.

2. The adjustable dumbbell system as claimed in claim 1, wherein the scissor hook comprises two hook members arranged in a crossed manner and pivotally connected together with the pivot axis on a middle part inside the respective weight, wherein each hook member has a top end terminating in a hook portion and an opposite bottom end terminating in a tail portion, and wherein the hook portions of the two hook members form the hook unit and the tail portions of the two hook members form the actuation unit.

3. The adjustable dumbbell system as claimed in claim 2, wherein the scissor hook further comprises a second elastic member and the pair of elastic members are disposed at the outer sides of the hook members and are compressible to store energy when the hook unit is opened.

4. The adjustable dumbbell system as claimed in claim 1, wherein the selector further comprises a shaft fixedly connected to the selector knob, and wherein each control unit is a cam wheel mounted on and rotatable with the shaft.

* * * * *